United States Patent [19]

Undin

[11] 4,121,092

[45] Oct. 17, 1978

[54] ELECTRIC POWER APPARATUS

[75] Inventor: Hans Undin, Akersberga, Sweden

[73] Assignee: Pressmaster, Ltd., Stockholm, Sweden

[21] Appl. No.: 669,443

[22] Filed: Mar. 23, 1976

[30] Foreign Application Priority Data

Mar. 27, 1975 [SE] Sweden ..... 7503590

[51] Int. Cl.[2] ..... H05B 1/02

[52] U.S. Cl. ..... 219/501; 219/494

[58] Field of Search ..... 219/490, 494, 501, 504, 219/505, 499, 497; 337/38, 39, 225 C

[56] References Cited

U.S. PATENT DOCUMENTS

| | | | |
|---|---|---|---|
| 3,275,802 | 9/1966 | Vandivere et al. | 219/501 |
| 3,780,263 | 12/1973 | Kuzyk | 219/501 |
| 3,982,098 | 9/1976 | Trostler | 219/505 X |

*Primary Examiner*—J. V. Truhe
*Assistant Examiner*—Fred E. Bell
*Attorney, Agent, or Firm*—Silverman & Jackson

[57] ABSTRACT

Apparatus for controlling the supply of electric power to a power consuming appliance (e.g. an electric soldering iron) in dependence on a parameter (e.g. the temperature of the soldering iron) comprises electric circuit means including a thyristor connected in series with the appliance across an AC supply, a first voltage divider including a variable resistor for defining a set point for said parameter, a second voltage divider including a sensor for said parameter and adapted to provide an analogue electrical parameter, and a first and a second transistor having their bases connected respectively to tappings of said voltage dividers defined respectively by a terminal of said variable resistor and said sensor, the emitter of said second transistor being connected to the gate of said thyristor.

8 Claims, 1 Drawing Figure

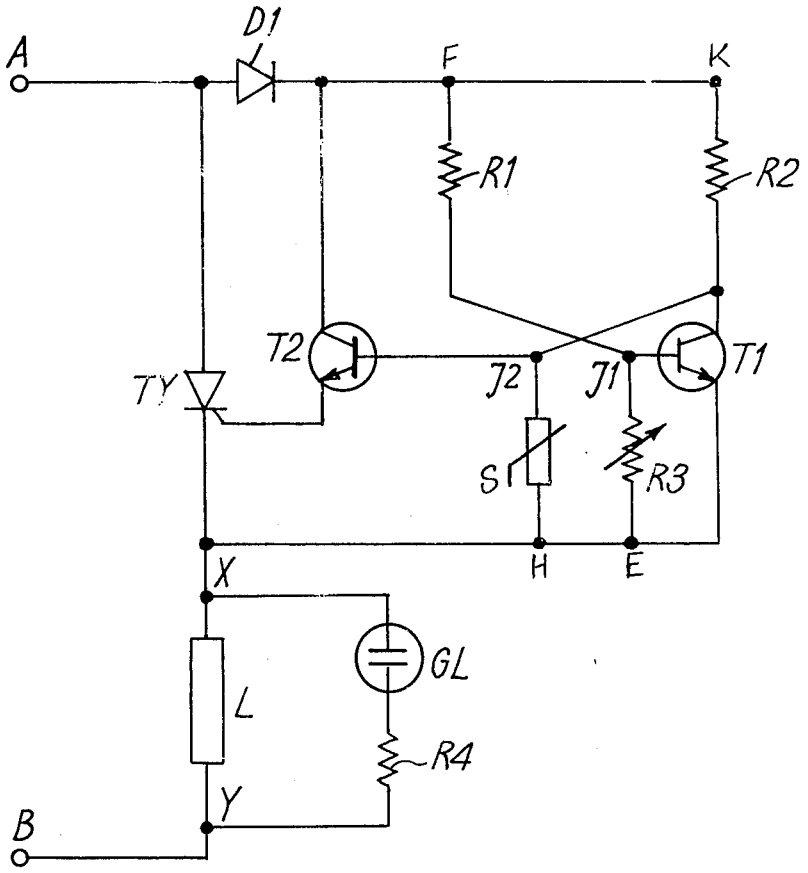
A
D1
F
K
R1
R2
T2
T1
TY
J2
J1
S
R3
H
E
X
GL
L
R4
Y
B

ELECTRIC POWER APPARATUS

This invention relates to electric circuit means for controlling the supply of electric power to a power consuming appliance in dependence on a parameter, particularly though not exclusively to a heat generating power consuming appliance, such as an electrically heated soldering iron in which said parameter is the temperature of the iron. The invention is particularly, though not exclusively, applicable to the control of the supply of electric power to soldering irons of the kind used for soldering various electric circuit components to printed circuit boards in the mass production of articles containing printed circuits, and also includes within its scope articles on which a soldering operation has been performed by means of such soldering irons.

Because of the special applicability of the invention as aforesaid, but without in any way limiting the scope of the invention thereto, the invention will hereinafter be explained and particularly described in the context of the control of heating elements of soldering equipment.

Previously such heating elements have commonly been supplied from an AC supply at a constant operating voltage. By suitable dimensioning of the heating elements in relation to the job for which they were designed and to the cooling effect of the ambient air to which they were exposed, overheating of the tips of the soldering irons was prevented, whilst the soldering equipment was in continuous operation. However, experience shows that these heating elements and the tips of the soldering irons associated therewith have a comparatively short life and that the operating efficiency of the latter is reduced due to the tendency to slag formation thereon. The power consumption is comparatively high and moreover the recovery time of the soldering tips is relatively long. By "recovery time" is meant the time required for the operating temperature of the soldering tip to be restored after completion of a soldering operation.

Temperature control of the heating elements offers several advantages. Thus, the heating elements can be designed for higher maximum temperatures and the time required to heat them from ambient temperature to the required operating temperature may be reduced considerably as compared with the aforesaid recovery time in the case of such heating elements which are continuously energised from a constant voltage source. Moreover, the temperature may be adapted to specific operating conditions. This is particularly important in cases where, for example, heat sensitive components have to be soldered on to a printed circuit board without damage to the components caused by overheating. However, temperature controlled heating elements previously proposed have several disadvantages and among other things tend to suffer from undesirable temperature fluctuations. Another common disadvantage of temperature control circuits for heat generating appliances previously proposed arises from the fact that the temperature sensor itself generates a considerable amount of heat which tends unduly to affect the control operation.

It is an object of the present invention to provide an electric circuit for controlling the supply of electric power to a power consuming appliance which, when applied to the control of heating elements as aforesaid, is capable of reducing or eliminating the disadvantages, and in particular the effect of the heat generation by the temperature sensor hereinbefore mentioned.

According to the invention, in a first aspect thereof, electric circuit means for controlling the supply of electric power to a power consuming appliance in dependence on a parameter comprise supply and appliance terminals for connecting the circuit means to an AC power supply and to said appliance; a set point device for providing a set point representing a desired value of the parameter as an electrical analogue of said value; a sensor responsive to an actual value of the parameter and representing an electrical angalogue of said actual value, said sensor being connected between a terminal and a tapping of a potential divider circuit; switch means for performing a switching operation such as repeatedly to connect a said appliance terminal to, and to disconnect it from, a said supply terminal; and control means for performing a control operation on said switching operation and connected so as to perform said control operation in dependence on said actual value and on said set point and so as to maintain any deviation of said actual value from said desired value within predetermined limits.

In a preferred form of the invention in said first aspect thereof, electric circuit means for controlling the supply of electric power to a power consuming appliance in dependence on a parameter comprise supply and appliance terminals for connecting the circuit means to an AC power supply and to said appliance; a set point resistor for providing a set point representing a desired value of the parameter as an electrical analogue of said value, said set point resistor being connected between a first terminal and a tapping of a first potential divider circuit and a first resistor being connected between said tapping and a second terminal of said first potential divider circuit; a sensor responsive to an actual value of the parameter and representing an electrical analogue of said actual value, said sensor being connected between a first terminal and a tapping of a second potential divider circuit and a second resistor being connected between said tapping and a second terminal of said second potential divider circuit; a thyristor for performing a switching operation such as repeatedly to connect a said appliance terminal to, and to disconnect it from, a said supply terminal; control means defined by a first and a second transistor for performing a control operation on said switching operation and connected so as to perform said control operation in dependence on said actual value and on said set point; and a diode connected so as to protect said transistors from injurious negative base-emitter voltages and, when said electric circuit means are connected to said AC power supply and said appliance, to prevent the supply of current to the appliance during alternate halfcycles of said AC supply; said first terminals of said potential dividers being connected to the emitter of said first transistor and to a said appliance terminal, said tapping of said first potential divider being connected to the base of said first transistor, said tapping of said second potential divider being connected to the base of said second transistor, the collector of said second transistor being connected in series with said diode to a said supply terminal, the emitter of said second transistor being connected to the gate of said thyristor, said thyristor being connected between said last-mentioned supply terminal and said last-mentioned appliance terminal, and a second supply terminal also defining a second appliance terminal.

In a preferred form of said electric circuit means, in which said power consuming appliance is a heating element, e.g. a heating element of a soldering iron, and wherein said parameter is a temperature, e.g. the temperature of said heating element, said sensor comprises a thermistor, the latter preferably having a negative temperature coefficient of resistance.

The set point of said set point device may be adjustable and may comprise a potentiometer.

In order to indicate the presence or absence of a voltage across said appliance terminals, a visual indicating device, preferably in the form of a lamp in series with a resistor, may be connected across said appliance terminals.

The invention also includes within its scope, in a second aspect thereof, an article having at least one soldered joint made by means of a soldering iron having a heating element defining the power consuming appliance of electric circuit means according to said first aspect of the invention.

One form of electric circuit means embodying the invention and applied to the temperature control of electric soldering equipment will now be described, by way of example only, with reference to the accompanying circuit diagram.

Referring to the diagram, the circuit means comprises supply terminals A and B for connecting the circuit means to a single-phase mains AC power supply of normal voltage, and appliance terminals X and Y of which the terminal Y is connected to the supply terminal B. A power consuming appliance in the form of a heating element L of a soldering iron is connected between the appliance terminals X and Y.

A set point device for providing a set point representing a desired value of the temperature of the heating element L, viz. a parameter of this element, as an electrical anologue of said value is provided in the form of an adjustable set point resistor or potentiometer R3 which is connected between a first terminal E and a tapping J1 of a first potential divider circuit, a resistor R1 of which is connected between the tapping J1 and a second terminal F of said potential divider circuit.

A thermistor S with a negative temperature coefficient of resistance, defining a sensor responsive to the actual value of the temperature of the heating element L and having a resistance which, by reason of said temperature coefficient of resistance, represents an electrical analogue of said actual value, is connected between a first terminal H and a tapping J2 of a second potential divider circuit, a resistor R2 of which is connected between the tapping J2 and a second terminal K of said second potential divider circuit, the terminal K being connected to the terminal F.

The gate of a thyristor TY defining switch means for performing a switching operation such as repeatedly to connect the terminal X to, and to disconnect it from, the terminal A is connected to control means defined by a first transistor T1 and a second transistor T2 for performing, in dependence on said actual value and on said set point, a control operation on said switching operation.

A diode D1 is connected so as to protect the transistors T1, T2 from injurious negative base-emitter voltages and to prevent the supply of current to the heating element L during alternate half-cycles of the AC supply.

The terminals E and H of said potential dividers are connected to the emitter of the transistor T1 and to the terminal X. The tapping J1 is connected to the base of the transistor T1 and the tapping J2 is connected to the base of the transistor T2. The collector of the transistor T2 is connected in series with the diode D1 to the terminal A. The emitter of the transistor T2 is connected to the gate of the thyristor TY, the latter being connected between the terminals A and X.

A visual indicating device in the form of an incandescent lamp GL, connected in series with a resistor R4, is provided across the terminals XY to indicate the presence or absence of a voltage across these terminals.

In operation of the circuit means, when the alternating supply voltage has risen to a value at which the voltage at the tapping J1 is approximately 0.5V, the transistor T1 is rendered conducting and the transistor T2 is effectively cut off. As will hereinafter be described, it is, of course, also possible that the transistor T2 is rendered conducting before the transistor T1.

The setting of the set point resistor or potentiometer R3 determines the operating voltage of the transistor T1, the resistance of the resistor R3, thus determining the desired operating temperature of the heating element L.

Unlike previously proposed control circuits for soldering irons and the like, the sensor S which in practice is located in close proximity to the heating element L and which would therefore tend to effect and distort the control signal of the circuit means by reason of the heat generated therein, is supplied with a voltage of only approximately 2–3V, so that the heat generated in the sensor S is negligible and this heat therefore has substantially no effect on the temperature control of the heating element L.

When the temperature of the tip of the soldering iron which is heated by the heating element L rises, the resistance of the thermistor S drops (by reason of its negative temperature coefficient of resistance) and a condition is quickly reached where the transistor T1 is rendered conducting before the transistor T2, in consequence of which the thyristor TY does not fire and no power is supplied to the heating element L via the terminal X. However, the thermistor S gradually cools and consequently its resistance rises again and in due course the thyristor TY fires and the operating cycle is repeated.

When the voltage at the tapping J2 reaches a value at which the transistor T2 is rendered conducting, a current flows in the collector of the transistor T2, the value of which is of the order of "current divided by the reistance of the resistor R2 and multiplied by $h_{FE}$", where "$h_{FE}$" is the amplification factor of the transistor.

If the thyristor TY is easily triggered, this current fires the thyristor TY and the voltage across the two potential dividers drops to approximately zero during the following half-cycle of the supply voltage. If the thyristor TY were not easily triggered, its firing would be delayed to the instant when the voltage applied to its gate has resin to a value such that the collector current of the transistor T2 reaches the threshold value of the thyristor firing current, which would be undesirable owing to the severe radio interference which this would cause.

The thyristor TY should therefore be easily triggered only when the transistor T2 is rendered conducting, provided of course that the leakage current of the transistor T2 is not sufficiently high for it to trigger the thyristor TY.

Since the heating element L of the soldering iron is supplied with power only during alternate half-cycles of the AC supply, the maximum current through the thyristor will, in a circuit made up of components as specified below, be 0.36A at 40W. The thyristor TY must of course be capable of withstanding the peak value of the supply voltage (viz. 1.41 times its RMS value). The resistance coil of the heating element L is of course so designed that it provides the requisite heat output with half-cycle operation as aforesaid.

The transistor T1 must withstand a voltage equal to the maximum line voltage reduced by the effect of the two voltage dividers. When the resistor R3 is set to zero resistance, this voltage will be more than 300V. In normal operation of the circuit means, i.e. for a temperature of the heating element L of a value required in practice, the resistance of the resistor R3 will be approximately 5000 ohm and the operating voltage of the transistor T2 approximately 30% above the supply voltage.

The lamp GL has a normal ignition voltage of 50–100V and emits light when power is applied to the heating element L and is extinguished when the heating element L reaches a temperature corresponding to the setting of the resistor R3.

Typically the various circuit components have the following values:

R1: $100 \times 10^3$ ohm; 300V; 0.25W; 10% tolerance
R2: $18 \times 10^3$ ohm; 300V; 0.5–1.30W; 10% tolerance
R3: $50 \times 10^3$ ohm (logarithmic resistor); 100V; 0.1–0.25W; 20% tolerance
R4: $150 \times 10^3$ ohm; 0.25V
S: Negative temperature coefficient; $350 \times 10^3$ ohm at 100° C. and $3 \times 10^3$ ohm at 300° C.; max. temp. 500° C.
T1: Operating voltage 300V; 10W; 1A; amplification factor ($h_{FE}$100)
T2:
D1: 400V; 20 mA
TY: 4A; gate current 0.2 mA; gate voltage 0.8V It will be appreciated that, although the invention has been explained in its application to the control of a heating element, the circuit means described could be used to control any other type of power consuming appliance, where the power supplied is to be related to a parameter (which need not necessarily be a parameter of the appliance itself) and need not necessarily be a temperature. Thus, the invention could, for example, also be applied to the torque control of an electric motor, in which case the load on, or power output of, the motor could be the said parameter and the torque controlled relative to said load or power output.

I claim:

1. Electric circuit means for controlling the supply of electric power to a power consuming appliance in dependence on a parameter, the circuit means comprising supply and appliance terminals for connecting the circuit means to an AC power supply and to said appliance; a first potential divider circuit comprising a first terminal, a second terminal, a first tapping between said first and second terminal, a set point resistor for providing a set point representing a desired value of the parameter as an electrical analogue of said value connected between said first terminal and said first tapping, and a first resistor connected between said second terminal and said first tapping; a second potential divider circuit comprising a third terminal, a fourth terminal, a second tapping between said third and fourth terminal, a sensor responsive to an actual value of the parameter and representing an electrical analogue of said actual value connected between said third terminal and said second tapping, and a second resistor connected between said fourth terminal and said second tapping; a thyristor for performing a switching operation such as repeatedly to connect a said appliance terminal to, and to disconnect it from, a said supply terminal; a first and a second transistor defining control means for performing a control operation on said switching operation and connecting so as to perform said control operation in dependence on said actual value and on said set point; a diode connected in series with the collector of said second transistor so as to protect said transistors from injurious negative base-emitter voltages and, when said electric circuit means are connected to said AC power supply and said appliance, to prevent the supply of current to the appliance during alternate half-cycles of said AC supply; said first and third terminals being connected to the emitter of said first transistor and to a said appliance terminal, said first tapping being connected to the base of said first transistor, said second tapping being connected to the base of said second transistor, the collector of said second transistor being connected in series with said diode to a said supply terminal, the emitter of said second transistor being connected to the gate of said thyristor, said thyristor being connected between said last-mentioned supply terminal and said last-mentioned appliance terminal, and a second supply terminal also defining a second appliance terminal.

2. Electric circuit means according to claim 1, wherein said parameter is a temperature and said sensor comprises a thermistor.

3. Electric circuit means according to claim 2, wherein said thermistor has a negative temperature coefficient of resistance.

4. Electric circuit means according to claim 1, wherein said set point of said set point device is adjustable and comprises a potentiometer.

5. Electric circuit means according to claim 1 and further comprising a visual indicating device connected across said appliance terminals to indicate whether a voltage is present across said appliance terminals.

6. Electric circuit means according to claim 6, wherein said visual indicating device comprises a lamp, and further comprising a resistor connected in series with said lamp.

7. Electric circuit means according to claim 1 and further comprising a heating element defining said power consuming appliance connected across said appliance terminals.

8. Electric circuit means according to claim 7, wherein said heating element is the heating element of a soldering iron.

* * * * *